US009874410B2

(12) United States Patent
Hammerdinger et al.

(10) Patent No.: US 9,874,410 B2
(45) Date of Patent: Jan. 23, 2018

(54) HEAT EXCHANGER WITH ELASTIC ELEMENT

(71) Applicant: LINDE AKTIENGESELLSCHAFT, München (DE)

(72) Inventors: Markus Hammerdinger, Tacherting (DE); Christoph Seeholzer, Trostberg (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 218 days.

(21) Appl. No.: 14/902,011

(22) PCT Filed: Jul. 10, 2014

(86) PCT No.: PCT/EP2014/001890
§ 371 (c)(1),
(2) Date: Dec. 30, 2015

(87) PCT Pub. No.: WO2015/007375
PCT Pub. Date: Jan. 22, 2015

(65) Prior Publication Data

US 2016/0370130 A1 Dec. 22, 2016

(30) Foreign Application Priority Data

Jul. 16, 2013 (EP) ..... 13003569

(51) Int. Cl.
*F28D 7/02* (2006.01)
*F28F 9/00* (2006.01)
(Continued)

(52) U.S. Cl.
CPC ..... *F28F 9/005* (2013.01); *F28D 7/04* (2013.01); *F28F 9/013* (2013.01); *F28F 9/0132* (2013.01); *F28F 2265/26* (2013.01)

(58) Field of Classification Search
CPC ..... F28F 9/005; F28F 9/013; F28F 9/0132; F28F 2265/26; F28D 7/04
(Continued)

(56) References Cited

U.S. PATENT DOCUMENTS 3,603,383 A * 9/1971 Michael ..... F22B 1/026 165/158
4,211,546 A * 7/1980 Jensen ..... B01J 19/0013 422/203
(Continued)

FOREIGN PATENT DOCUMENTS

DE 4115250 C1 * 9/1992 ..... F28D 7/024
FR 2 319867 A1 2/1977

*Primary Examiner* — Justin Jonaitis

(57) ABSTRACT

A heat exchanger for indirect heat exchange between a first fluid and a second fluid, with a shell surrounding a shell space for receiving the first fluid, a tube bundle having a plurality of tubes arranged in the shell space for receiving the second fluid, the tubes arranged in a number of tube layers, and a jacket arranged in the shell space and enclosing an outermost tube layer in the radial direction of the tube bundle. An intermediate space is formed between the tube bundle and the jacket surrounds the tube bundle. At least one elastic element is arranged with a first region between neighboring tube portions in the outermost tube layer and a second region that protrudes out of the outermost tube layer and abuts an inner side of the jacket (3) that is facing the tube bundle or connects the elastic element to the jacket.

17 Claims, 3 Drawing Sheets

(51) Int. Cl.
*F28F 9/013* (2006.01)
*F28D 7/04* (2006.01)

(58) Field of Classification Search
USPC ..... 165/163, 160, 162
See application file for complete search history.

(56) References Cited

U.S. PATENT DOCUMENTS 4,265,301 A * 5/1981 Anderson ..... F28D 7/16 165/162
4,384,697 A * 5/1983 Ruhe ..... F28F 9/0135 165/162
4,386,456 A * 6/1983 Volz ..... B23P 15/26 165/162
4,462,339 A * 7/1984 Jahnke ..... F22B 1/1892 122/32
4,771,738 A * 9/1988 Ewbank ..... F22B 21/26 122/21
2009/0218086 A1 * 9/2009 Sciorelli ..... F02K 9/64 165/181

* cited by examiner

HEAT EXCHANGER WITH ELASTIC ELEMENT

The invention relates to a heat exchanger and to the use thereof.

Such a heat exchanger has a pressure-bearing shell, which bounds a shell space for receiving a first fluid. Arranged in the shell space is a tube bundle comprising a plurality of tubes for receiving a second fluid, the tubes being arranged in a number of tube layers, so that the second fluid can enter into an indirect heat exchange with the first fluid, carried in the shell space. Furthermore, such a heat exchanger has a jacket, which is arranged in the shell space and surrounds the tube bundle, so that a smallest possible intermediate space surrounding the tube bundle is formed between the tube bundle and the jacket. The arrangement of such a jacket around the tube bundle is intended to suppress an excessive bypass flow of the first fluid past the tube bundle, which would have adverse effects on the effectiveness of the heat exchanger. In some cases, however, it may be necessary that the jacket requires a greater distance from the tube bundle of the heat exchanger on account of operational temperature conditions. This increased intermediate space serves the purpose of compensating for temperature-induced movements of the tube bundle and the jacket.

EP 1 790 932 A1 discloses a helically coiled heat exchanger of the type described at the beginning, which has an elastic component that is arranged between the jacket and the outer tube layer, the elastic component being applied to the outermost tube layer. The elastic component allows a thermally induced stress to be reduced by decoupling the thermal change in diameter of the tubes and the jacket. On account of the arrangement of the previously known elastic components on the outermost tube layer, between the jacket and the outermost tube layer there is a corresponding intermediate space, which is dictated by the dimensions of the elastic component in the radial direction of the tube bundle.

However, it is problematic here that the intermediate space between the jacket and the outermost tube layer allows an undesired bypass flow of the jacket-enclosed first fluid past the tube bundle, this part not participating, or only to a small extent, in the heat exchange with the second fluid, which is carried in the tube bundle.

This can lead to considerable impairment of the heat exchanger. For example, in the case of a falling film evaporator, an excessive bypass flow may lead to an increased occurrence of liquid in the sump of the heat exchanger. If the liquid level rises too high as a result, the output of such a heat exchanger must be reduced or the liquid (first fluid) extracted from the system, in order in particular to prevent a shutdown of the plant.

On this basis, the present invention therefore addresses the problem of developing a heat exchanger of the type mentioned at the beginning in such a way that the aforementioned disadvantages are reduced.

This problem is solved by a heat exchanger for indirect heat exchange between a first fluid and a second fluid, with a shell which surrounds a shell space for receiving the first fluid, a tube bundle comprising a plurality of tubes arranged in the shell space and intended for receiving the second fluid, the tubes being coiled in a number of tube layers around a core tube of the tube bundle and a jacket, which is arranged in the shell space and encloses an outermost tube layer of the tube bundle in the radial direction of the tube bundle, so that between the tube bundle and that jacket there is formed an intermediate space surrounding the tube bundle.

It is accordingly provided that at least one elastic element is arranged in certain portions, i.e. with a first region, between neighboring tube portions in the outermost tube layer, the at least one elastic element having a second region, which protrudes out of the outermost tube layer along the radial direction of the tube bundle in the direction of the jacket, and the at least one elastic element abutting with its second region, protruding from the outermost tube layer, against the inner side of the jacket that is facing the tube bundle or the outermost tube layer, or the elastic element being designed for this. Alternatively or in addition, that region serves for connecting the elastic element to the jacket.

An "outermost tube layer of the tube bundle" should be understood here as meaning in particular the tube layer that is neighboring the jacket and is at the smallest distance—in comparison with the other tube layers of the tube bundle—from the jacket in the radial direction of the tube bundle.

The temperatures of the first and second fluids cause thermally induced stresses between the tube bundle, in particular the outermost tube layer, and the jacket—for example on account of thermal changes in diameter of the tubes and the jacket. The at least one elastic element in this case allows a decoupling of these thermal changes in diameter of the tubes and the jacket, so that these stresses can be reduced or prevented.

The integration according to the invention of the at least one elastic element in the outermost tube layer of the heat exchanger allows the intermediate space between the outermost tube layer and the inner side of the jacket that is produced by the at least one elastic element to be made much smaller than in the prior art, and nevertheless the required amount of distance for the thermal expansion to be provided. This is made possible by the mounting no longer taking place on the outermost layer of the heat exchanger but in the outermost layer of the heat exchanger, as a result of which the distance or installation space required for mounting, which of course does not take part in the elastic deformation, no longer remains as a dead gap on the outermost tube layer.

In particular, the at least one elastic element is what is known as a non-heat-exchanging element, in the sense that the at least one elastic element is not in direct contact with the two fluids (like for example the tubes of the tube bundle).

If, for example, the first fluid, which is inter alia in contact with the jacket, has a low temperature, the jacket contracts and enters into interaction with the at least one elastic element. The at least one elastic element is in this case designed in such a way that it deforms elastically—on account of the force acting on the at least one elastic element as a result of the contraction of the jacket, while in return the jacket only undergoes a small deformation, or no deformation, at the locations at which it enters into interaction with the at least one elastic element (the same applies analogously to the tube bundle or the tubes thereof). As a result, a thermally induced force transfer (on account of the thermal change in diameter described) between the tubes and the jacket is prevented or reduced, since the jacket does not enter into interaction with the lubes of the outermost tube layer at all, or only to a comparatively small extent. Consequently, damage to the heat exchanger, such as for example tearing of the jacket, is prevented.

The arrangement of the at least one elastic element between neighboring tube portions—these are in particular directly neighboring tube portions of a tube of the outermost tube layer—allows the provision of an intermediate space, with a comparatively smaller volume, without at the same time having to lessen the requirements for the configuration of the at least one elastic element. Consequently—in other words—the arrangement of the at least one elastic element takes place at least in certain portions within the outermost tube layer, i.e. a first region of the at least one elastic element is arranged in the first tube layer while a second region of the at least one elastic element protrudes radially out of the outermost tube layer. This has the advantage that a bypass flow of the shell-enclosed first fluid past the tube bundle (on account of the smaller volume of the intermediate space) is reduced, so that the efficiency of the heat exchange of the shell-enclosed first fluid with the second fluid, which flows through the interior of the tubes, is impaired less.

According to the invention, the tubes of the tube bundle are coiled in a number of tube layers around a core tube of the heat exchanger, i.e. the heat exchanger is what is known as a helically coiled heat exchanger. The core tube generally extends along a longitudinal axis, which preferably runs along the vertical with respect to a state of the heat exchanger arranged as intended. The shell of the heat exchanger preferably extends along this longitudinal axis, which in particular forms a cylinder axis of the shell.

Preferably, at least one spacing element is respectively arranged between tube layers neighboring in the radial direction of the tube bundle. The "radial direction" should be understood in the present case as meaning the direction that runs along the radius of the core tube or tube bundle and is respectively perpendicular to the longitudinal axis or the vertical and is directed away therefrom.

"Neighboring tube portions of the outermost tube layer" should be understood as meaning in particular the portions of one and the same tube or of two tubes of the outermost tube layer that lie neighboring one another or lying one over the other along the longitudinal axis, these being direct neighbors, i.e. no further tube portion is arranged between each two such tube portions along the longitudinal axis of the heat exchanger or core tube, but possibly one of the elastic elements according to the invention (see above).

An "elastic element" is understood according to the invention as meaning an element or component of which the capability for reversible deformation is greater (in the sense that a smaller force is necessary to achieve an elastic deformation) than that of the neighboring components, in particular the tubes, the jacket or the spacing elements. In principle, when there is an interaction of the elastic element with the jacket, a reversible elastic deformation of the elastic element takes place, the jacket (or the other components interacting with the elastic element, such as for example the spacing elements and/or the tubes of the outermost tube layer) not undergoing any elastic deformation, or far less elastic deformation, as a result of an interaction with the at least one elastic element. Temperature-induced expansions/contractions of these components are possible, but an interaction with the elastic element does not lead to a deformation, or only a small deformation, in the region of the interaction or the contact. The reversibility makes it possible that the at least one elastic element abutting against the jacket can deform elastically when there is a temperature-induced deformation, such as for example a contraction of the jacket, and can revert to the non-deformed original state when the temperature-induced deformation is discontinued.

The necessary deformation force to achieve a reversible deformation of the at least one elastic element is consequently smaller than the necessary deformation force for a corresponding deformation of the tubes, the jacket or the spacing elements. This allows a heat-induced relative movement between the tube bundle and the jacket, in the case of which the distance between the jacket and the outermost tube layer changes and consequently said intermediate space varies in its volume.

"Elastic" is understood according to the invention as meaning both a linear elasticity and a non-linear elasticity (for example rubber elasticity). In particular, the term "elastic" is understood as meaning an elasticity that also exists at temperatures of −196° C. to 100° C., in particular −165 to 65° C. The elastic element is consequently designed in particular to be elastic at these temperatures and can perform the reversible deformation described above.

In some embodiments, the spring constant of the at least one elastic element is preferably less than 80%, preferably less than 50%, preferably less than 10% or preferably less than 1% than the spring constant of the tubes, the spacing elements or the jacket.

The at least one elastic element may be connected to the jacket in an interlocking, frictionally engaging and/or material-bonding manner.

Furthermore, the at least one elastic element may be fixed to the tube bundle, in particular in an interlocking, frictionally engaging and/or material-bonding manner, by way of a spacing element which is arranged between the outermost tube layer and the neighboring tube layer. Thus, for example, the at least one elastic element may be welded to the jacket and the spacing element. It is possible in principle that the at least one elastic element is connected either to the jacket or to the spacing element merely in a sliding manner, i.e. it abuts against these components, which allows further decoupling of the tube bundle from the surrounding jacket.

The distance between the outermost tube layer and the inner side of the jacket (i.e. the thickness of the intermediate space) preferably lies in a range from 1 mm to 10 mm.

It is also conceivable that the at least one elastic element is formed as extending longitudinally (that is to say has a greater extent along a direction of longitudinal extent than perpendicularly thereto), it extending in its direction of longitudinal extent between two tube portions of the tube bundle and along those tube portions. Here, the elastic element may in particular run around the core tube, which as a consequence has the advantage of further suppressing a bypass flow of the first fluid past the tube bundle.

In principle, the elastic element may be formed as a helical spring, a leaf spring or a cup spring or some other spring element or comprise such elements. Furthermore, the elastic element may be formed in a spherical or cylindrical manner, for example in the form of a solid or hollow body.

In one embodiment of the invention, the at least one elastic element has two legs, which are connected to one another by way of a base and each have an end region, those end regions abutting against the inner side of the jacket. The legs preferably diverge from one another from the base in the direction of the jacket and form in particular an included angle of 30° to 50°, preferably 40°, that angle increasing when there is elastic deformation of the elastic element, which corresponds to a reduction in the expansion of the elastic element normal to the jacket.

The at least one elastic element is preferably fixed to that at least one spacing element by way of the base, in particular by way of a welded connection, it being possible for a connection to the jacket to take place by means of clamping. The legs protrude in certain portions out of the outermost tube layer, those portions of the legs forming the region of the elastic element that protrudes out of the tube layer.

Furthermore, the legs may be formed integrally with one another by way of the base. Furthermore, the end regions are preferably curved convexly toward the jacket, so that they respectively form a convexly curved abutting surface for the jacket.

The two legs of the elastic element may in turn be designed so as to extend along that direction of longitudinal extent defined above, in order to suppress a bypass flow.

The at least one elastic element preferably comprises a metal and/or plastic; in particular, the at least one elastic element comprises a stainless high-grade steel, for example according to the standard EN 10020, in particular a stainless spring steel of the material number 1.4310, and/or PTFE (polytetrafluoroethylene), for example Teflon.

The heat exchanger preferably has a plurality of elastic elements, which are respectively arranged in certain portions between neighboring tube portions of the outermost tube layer, that is to say are integrated in the outermost tube layer, the respective elastic element having a region which protrudes out of the outermost tube layer in the radial direction of the tube bundle and is intended for abutment against the inner side of the jacket of the heat exchanger that is facing the tube bundle 2, it also being possible for that region alternatively or additionally to be designed for connecting the respective elastic element to the jacket. The individual elastic elements may in turn be configured in the way described above.

A number of elastic elements according to the invention are preferably respectively arranged next to one another along the circumference of the tube bundle or along the direction of longitudinal extent of a tube of the tube bundle. Furthermore, a number of elastic elements according to the invention are preferably respectively arranged one over the other along the longitudinal axis of the heat exchanger, so that the elastic elements are particular distributed substantially uniformly over the outermost tube layer.

The heat exchanger according to the invention is preferably used for carrying out an indirect heat exchange between a refrigerant stream as the first fluid and a hydrocarbon-containing stream as the second fluid, the hydrocarbon-containing stream being formed in particular by natural gas.

Further details and advantages of the invention are to be explained by the following description of figures of an exemplary embodiment on the basis of the figures, in which:

FIG. 1 shows in conjunction with FIG. 2 a heat exchanger 1 according to the invention with a plurality of elastic elements 5.

The heat exchanger 1 is designed for indirect heat exchange between a first fluid and a second fluid and has a shell 10, which surrounds a shell space M for receiving the first fluid, which can be introduced by way of an inlet stub 101 on the shell 10 into the shell space M and can be extracted again from the shell space M by way of a corresponding outlet stub 102 on the shell 10.

Figure 1:
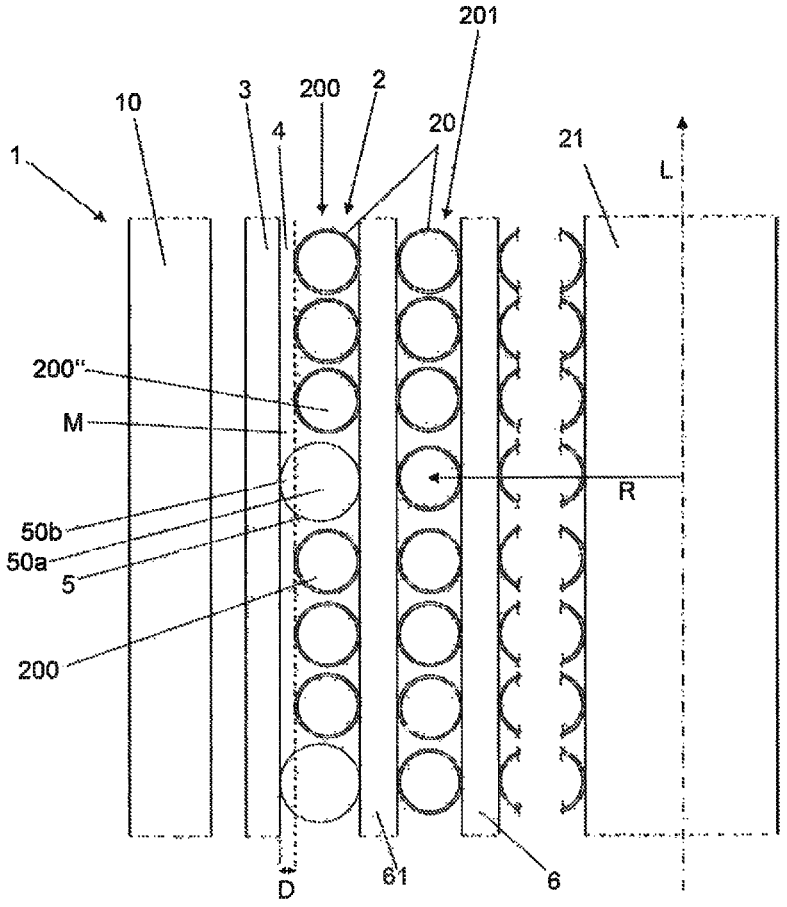
FIG. 1 shows a sectional view in the form of a detail of a heat exchanger according to the invention.

In this case, the shell 10 extends along a longitudinal axis L, which runs along the vertical with respect to a state of the heat exchanger 1 arranged as intended. Also arranged in the shell space M is a tube bundle 2 with a plurality of tubes 20 tor receiving the second fluid. In this case, the tubes 20 are coiled helically around a core tube 21 in a number of tube layers 200, 201 (for the sake of overall clarity, only the outermost tube layer 200 and the tube layer 201 located thereunder are represented in FIG. 1), the core tube 21 likewise extending along the longitudinal axis L and being arranged concentrically in the shell space M. A number of tubes 20 are respectively grouped together in a tube sheet 104, it being possible for the second fluid to be introduced by way of inlet stub 103 on the shell 10 into those tubes 20 and extracted again from the tubes 20 by way of outlet stub 105. Consequently, heat can be exchanged indirectly between the two fluids, these fluids preferably being carried through the heat exchanger 1 in counterflow.

The shell 10 and the core tube 21 are of a cylindrical configuration, at least in certain portions, so that the longitudinal axis L forms a cylinder axis of the shell 10 and of the core tube 21 running concentrically therein. Also arranged in the shell space M is a jacket 3, which encloses the tube bundle 2, so that between the tube bundle 2 and that jacket 3 there is formed an intermediate space 4 surrounding the tube bundle 2. The jacket 3 serves the purpose of suppressing as far as possible a bypass flow of the first fluid, which is carried in the shell space M and to which the tube bundle 2 is subjected, past the tube bundle 2. The first fluid is therefore carried in the shell space M in the region of the shell space M that is surrounded by the jacket 3.

Furthermore, the individual tube layers 200, 201 are supported (in particular when there is horizontal mounting of the tube bundle 2) on one another or on the core tube 21 by way of spacing elements 61, 6 made to extend along the longitudinal axis L, a number of spacing elements 61, 6 being respectively arranged one over the other in the radial direction R of the tube bundle 2.

For decoupling heat-induced stresses/movements of the jacket 3 and the tubes 20 or tube bundle 2 with respect to one another, a number of elastic elements 5 are provided (in FIG. 2, three such elements 5 are shown by way of example), respectively integrated in the outermost tube layer 200, the elastic elements 5 preferably being distributed substantially uniformly over the first tube layer 200. In this case, the elastic elements 5 are respectively arranged with a first region 50*a* between tube portions 200', 200" of the outermost tube layer 200 that are neighboring along the longitudinal axis L, a second region 50*b* of the respective elastic element 5, which serves for abutment against an inner side of the jacket 3 that is facing the tube bundle 2 (or for the connection to the jacket 3), respectively protruding out of the outermost tube layer 200 in the radial direction R of the tube bundle 2 or of the core tube 21 in the direction of the jacket 3.

The elastic elements 5 are in this case preferably respectively fixed to an outermost spacing element 61 in the radial direction R, in particular by way of a welded connection, and abut against the inner side of the jacket 3 in a sliding manner by way of the respective second region 50*b*. Other ways of fastening to the jacket 3 and/or to the respective spacing element 61 are likewise possible (see above).

The outermost tube layer 200 is at a distance D from the inner side of the jacket 3 along the radial direction R (with respect to a non-operational state) that lies in particular in a range from 2 mm to 10 mm and allows the usually occurring heat-induced movements of the jacket 3 and the tube bundle 2 with respect to one another during the operation of the heat exchanger 1.

The arrangement of the elastic elements 5 between the inner side of the jacket 3 and the respective outermost spacing element 61 allows sufficient decoupling of the outermost tube layer 200 or the tube bundle 2 on the one hand and the jacket 3 on the other hand, which makes a reduction in heat-induced stresses possible and at the same time keeps the thickness of the intermediate space 4 as small as possible.

Figure 2:
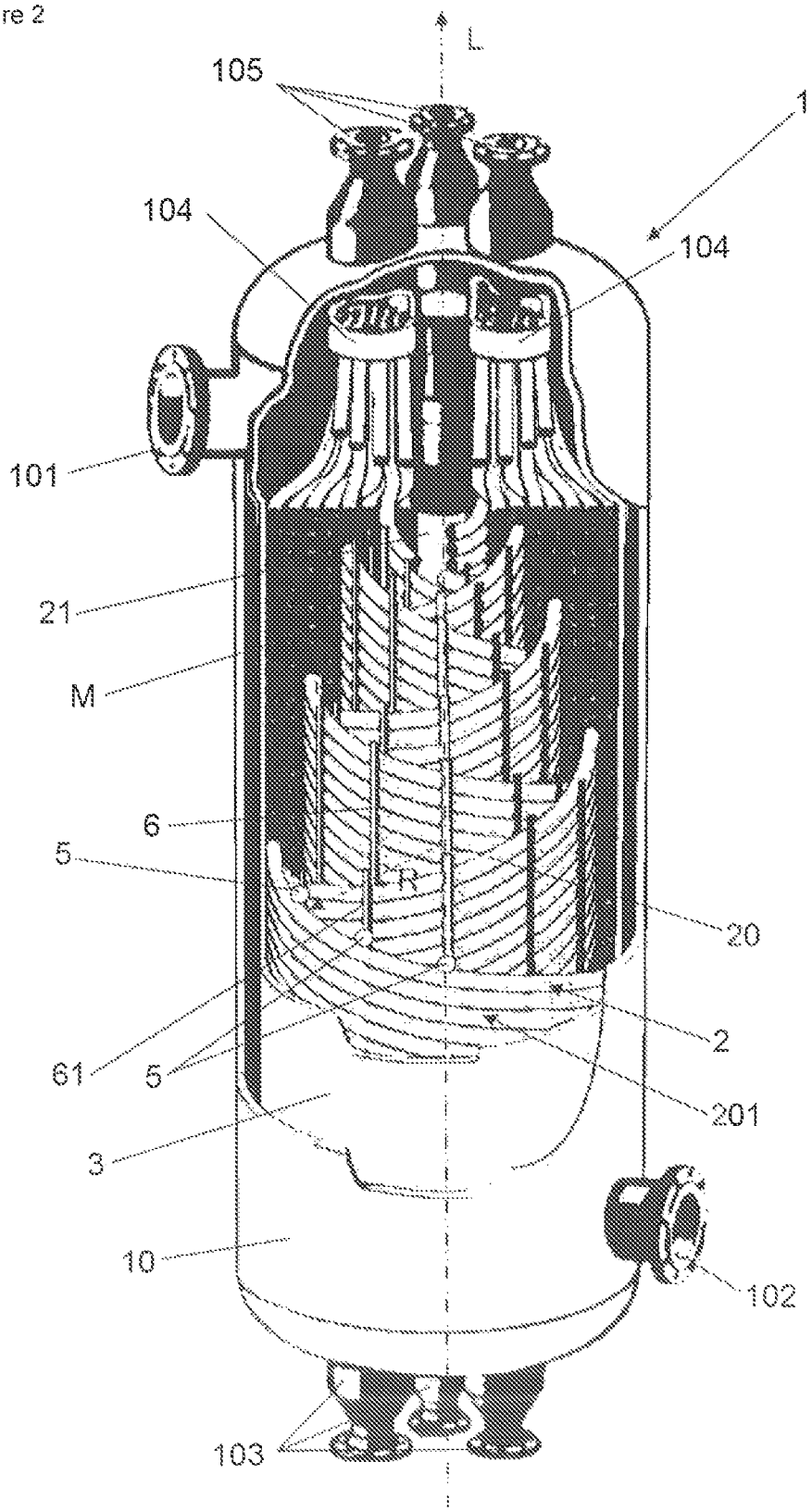
FIG. 2 shows a partially sectioned, perspective view of a helically coiled heat exchanger with elastic elements according to the invention.
Figure 3:
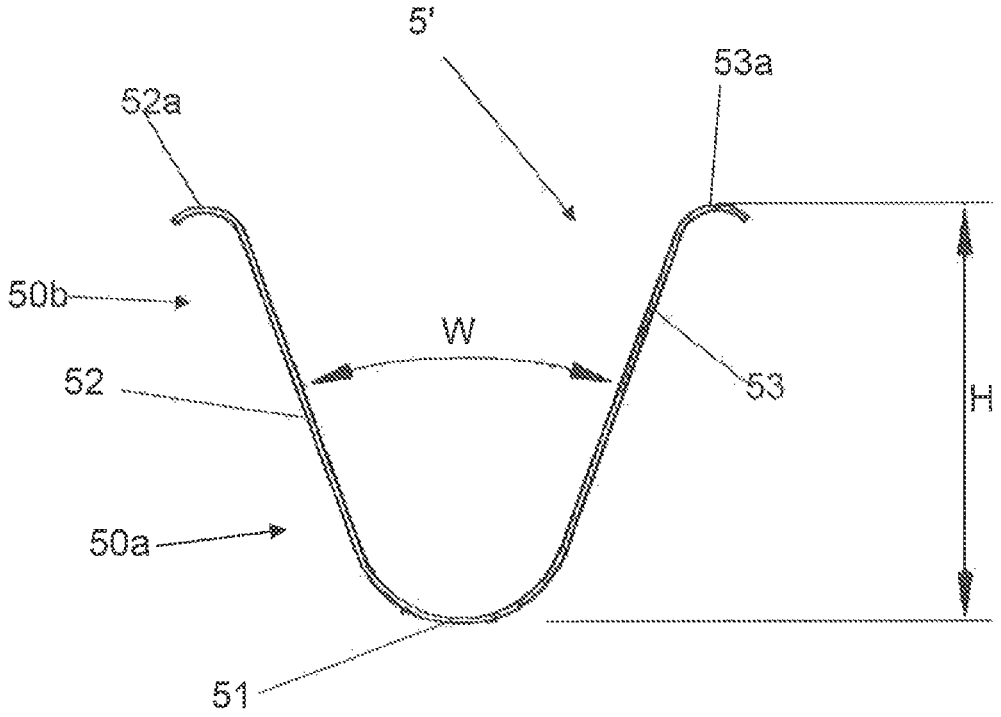
FIG. 3 shows a cross section of an embodiment of an elastic element according to the invention.

FIG. 3 shows a further embodiment of an elastic element 5' according to the invention, which may be used for example instead of the elastic element 5 in the case of a heat exchanger 1 according to FIG. 2. According to FIG. 3, the elastic element 5' has two legs 52, 53, which are formed integrally with one another by way of a curved or rounded base 51 and each have an end region 52*a*, 53*a*, those end regions 52*a*, 53*a* respectively forming a convex abutting surface for abutment against the inner side 3*a* of the jacket 3. In this case, the legs 52, 53 diverge from the base 51, by way of which they are fixed to the spacing layer 61 (for example by a welded connection or clamping between the jacket 3 and the spacing element 61), in the direction of the jacket 3. The legs 51, 52 may thereby form an included angle W of for example 40°. The thickness of the legs 52, 53 may be between 0.3 mm and 0.5 mm, in particular 0.4 mm.

The base 51 of the elastic element 5' is therefore arranged between neighboring tube portions 200', 200" of the outermost tube layer 200 or in the outermost tube layer 200 and belongs to the first region 50*a* of the elastic element 5', while those end regions 52*a*, 53*a* of the legs 52, 53 belong to the protruding second region 50*b* of the elastic element 5'. The elastic element 5' may have a height H in the radial direction R of the tube bundle 2 of for example 20 mm to 35 mm, preferably 28 mm.

When a force acts on the elastic element 5'—for example on account of contraction of the jacket 3—there takes place a reversible, elastic deformation of the elastic element 5', in which the legs 52, 53 move away from one another, so that the free end regions 52*a*, 53*a* slide along on the inner side 3*a* of the jacket 3 in opposite directions. When there is a reversal of the temperature-induced contraction of the jacket 3, the elastic element 5' moves back again in the direction of its original state. Consequently, a decoupling of the thermal movements of the jacket and the tubes 20 takes place.

List of reference signs

| | |
|---|---|
| 1 | Heat exchanger |
| 2 | Tube bundle |
| 3 | Jacket |
| 4 | Intermediate space |
| 5, 5' | Elastic element |
| 6, 61 | Spacing elements |
| 10 | Shell |
| 20 | Tubes |
| 21 | Core tube |
| 50a | First region |
| 50b | Protruding second region |
| 51 | Base |
| 52 | Leg |
| 53 | Leg |
| 52a | End region |
| 53a | End region |
| 101 | Inlet stub |
| 102 | Outlet stub |
| 103 | Inlet stub |
| 104 | Tube sheet |
| 105 | Outlet stub |
| 200, 201 | Tube layers |
| 200', 200" | Neighboring tube portions |
| D | Distance between jacket and outermost tube layer |
| H | Height |
| R | Radial direction |
| L | Longitudinal axis |
| M | Shell space |
| W | Angle |

The invention claimed is:

1. A heat exchanger for indirect heat exchange between a first fluid and a second fluid, with a shell, which surrounds a shell space for receiving the first fluid, a tube bundle comprising a plurality of tubes arranged in the shell space and intended for receiving the second fluid, the tubes being coiled in a number of tube layers around a core tube of the tube bundle and a jacket, which is arranged in the shell space and encloses an outermost tube layer of the tube bundle in the radial direction of the tube bundle, so that between the tube bundle and that jacket there is formed an intermediate space surrounding the tube bundle, characterized in that at least one elastic element is arranged with a first region between neighboring tube portions in the outermost tube layer, the at least one elastic element having a second region, which protrudes out of the outermost tube layer and is intended for abutment against an inner side of the jacket that is facing the tube bundle and/or is designed for connecting the elastic element to the jacket.

2. The heat exchanger as claimed in claim 1, characterized in that the core tube is made to extend along a longitudinal axis such that a radial direction is oriented perpendicularly to the longitudinal axis.

3. The heat exchanger as claimed in claim 2, characterized in that the heat exchanger has at least one spacing element between the outermost tube layer and the tube layer neighboring in the radial direction of the tube bundle, the at least one elastic element being fixed to the at least one spacing element and/or abutting against the at least one spacing element, in particular further spacing elements being provided between tube layers neighboring in the radial direction, these further spacing elements being arranged under the at least one spacing element to support the individual tube layers in the radial direction of the tube bundle.

4. The heat exchanger as claimed in claim 2, characterized in that the at least one elastic element extends longitudinally in the outermost tube layer.

5. The heat exchanger as claimed in claim 4, wherein the at least one elastic element is a plurality of elastic elements spaced around the core tube.

6. The heat exchanger as claimed in claim 5, wherein the plurality of elastic elements are helically spaced around the core tube.

7. The heat exchanger as claimed in claim 2, characterized in that the at least one elastic element is designed as a spring element.

8. The heat exchanger as claimed in claim 7, wherein the spring element is a leaf spring.

9. The heat exchanger as claimed in claim 1, characterized in that the at least one elastic element has two legs, which are connected by way of a base and each has an end region those end regions belonging to the second region and abutting against the inner side of the jacket, in particular the legs diverging from the base, which belongs to the first region, and in particular the elastic element being fixed to that at least one spacing element by way of the base.

10. The heat exchanger as claimed in claim 1, characterized in that the at least one elastic element is formed in a spherical or cylindrical manner.

11. The heat exchanger as claimed in claim 1, characterized in that the at least one elastic element comprises a metal or a plastic.

12. The heat exchanger as claimed in claim 11, wherein the at least one elastic element is comprised of high-grade steel.

13. The heat exchanger as claimed in claim 11, wherein the at least one elastic element is comprised of PTFE.

14. The heat exchanger as claimed claim 1, characterized in that a plurality of elastic elements are provided, respectively arranged with a first region between neighboring tube portions in the outermost tube layer, the respective elastic element having a second region, which protrudes out of the outermost tube layer and is intended for abutment against an inner side of the jacket that is facing the tube bundle and/or is designed for connection to the jacket.

15. The heat exchanger as claimed in claim 14, wherein a number of elastic elements are arranged one over the other along the longitudinal axis.

16. The use of a heat exchanger for indirect heat exchange between a first fluid and a second fluid, the heat exchanger having a shell, which surrounds a shell space for receiving the first fluid, a tube bundle comprising a plurality of tubes arranged in the shell space and intended for receiving the second fluid, the tubes being coiled in a number of tube layers around a core tube of the tube bundle and a jacket which is arranged in the shell space and encloses an outermost tube layer of the tube bundle in the radial direction of the tube bundle, so that between the tube bundle and the jacket there is formed an intermediate space surrounding the tube bundle, the heat exchanger further having at least one elastic element arranged with a first region between neighboring tube portions in the outermost tube layer, the at least one elastic element having a second region, which protrudes out of the outermost tube layer and is intended for abutment against an inner side of the jacket that is facing the tube bundle or is designed for connecting the elastic element to the jacket;

wherein the first fluid is a refrigerant stream and the second fluid is a hydrocarbon-containing stream.

17. The heat exchanger as claimed in claim 16, wherein the hydrocarbon-containing stream is natural gas.

* * * * *